US009586403B2

(12) United States Patent
Andres

(10) Patent No.: US 9,586,403 B2
(45) Date of Patent: Mar. 7, 2017

(54) INK PRINTING APPARATUS

(71) Applicant: Oce Printing Systems GmbH & Co. KG, Poing (DE)

(72) Inventor: Matthias Andres, Poing (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/965,091

(22) Filed: Dec. 10, 2015

(65) Prior Publication Data

US 2016/0167380 A1 Jun. 16, 2016

(30) Foreign Application Priority Data

Dec. 10, 2014 (DE) ..... 10 2014 118 295

(51) Int. Cl.
*B41J 2/165* (2006.01)
*B41J 2/17* (2006.01)

(52) U.S. Cl.
CPC ..... *B41J 2/165* (2013.01); *B41J 2/16585* (2013.01); *B41J 2/1714* (2013.01)

(58) Field of Classification Search
CPC ..... B41J 2/145
See application file for complete search history.

(56) References Cited

U.S. PATENT DOCUMENTS 4,228,442 A 10/1980 Krull
7,281,778 B2 10/2007 Hasenbein et al.
8,464,118 B2 6/2013 Nikkila et al.
8,622,538 B2 1/2014 Miyakoshi et al.
2009/0303285 A1 12/2009 Matsuhashi
2010/0066771 A1 3/2010 Hiratsuka et al.
2011/0109710 A1* 5/2011 Miyakoshi ..... B41J 2/165 347/104
2011/0181639 A1 7/2011 Leoni et al.
2011/0273510 A1 11/2011 Sugimoto et al.
2014/0176639 A1 6/2014 Tunmore et al.

FOREIGN PATENT DOCUMENTS

EP 0788882 A2 8/1997
EP 2418087 A1 2/2012
JP 2005271314 A 10/2005

* cited by examiner

*Primary Examiner* — Justin Seo
*Assistant Examiner* — Roger W Pisha, II
(74) *Attorney, Agent, or Firm* — Schiff Hardin LLP

(57) ABSTRACT

In a printing apparatus a print bar assembly is provided with multiple print bars, a designed space being present between the print bars and a recording medium. A climate control has a feed channel running parallel to a length of the recording medium. Openings lead from the feed channel to the print bars to introduce a conditioned gas flow of predetermined temperature and moisture to the print bars such that a laminar gas flow is generated in the designed space between nozzle plates of the print bars and the recording medium. A barrier is arranged at an intake of the print bar assembly which blocks an air boundary layer entrained with the moving recording medium before the print bar assembly.

14 Claims, 8 Drawing Sheets

INK PRINTING APPARATUS

BACKGROUND

Ink printing apparatuses may be used for single-color or multicolor printing to a printing substrate, for example a single sheet or a web-shaped recording medium made of the most varied materials (paper, for example). The design of such ink printing apparatuses is known-see for example EP 0 788 882 B1. Ink printing apparatuses that operate according to the Drop-on-Demand (DoD) principle, for example, have as a printer one print head or multiple print heads with nozzle assemblies comprising ink channels and activators, wherein the activators—controlled by a printer controller—may excite ink droplets in the direction of the recording medium, which ink droplets are directed onto the recording medium in order to apply print dots there for a print image. The activators may generate ink droplets thermally (bubble jet) or piezoelectrically.

The design of a print head which has, for example, nozzle assemblies with piezoelectric activators is known from U.S. Pat. No. 7,281,778 B2. Each nozzle assembly comprises ink channels that end in nozzles arranged in a nozzle plate and provides activators that are respectively arranged at an ink channel. The recording medium is directed past the nozzle plate. If it should be printed, the activators provided for printing are activated by a printer controller that thereupon subjects the ink in the ink channels to pressure waves via which the ejection of ink droplets from the nozzles in the direction of the recording medium is induced.

Given low print utilizations of the ink printing apparatus, not all nozzles of the ink print heads are activated in the printing process. Many nozzles still have downtimes (printing pauses), with the result that the ink in the ink channel of these nozzles is not moved. Due to the effect of evaporation from the nozzle opening, the danger exists from this that the viscosity of the ink then changes. This has the result that the ink in the ink channel can no longer move optimally and, for example, can no longer exit from the nozzle. In extreme cases, the ink in the ink channel dries completely and clogs the ink channel, such that a printing with this nozzle is no longer possible.

The drying of the ink in the nozzles may be prevented in that printing occurs from all nozzles within a predetermined cycle. This cycle may be set corresponding to the print utilization. Individual points may thereby be applied in unprinted regions of the recording medium, or print dot lines may be printed between print pages. These methods may lead to disruptions in the print image, in addition to unnecessary ink consumption and additional wear of the print heads.

A drying of the ink in the nozzles of a print head in its printing pauses represents a problem that may also be prevented in that a purge medium (for example ink or cleaning fluid) is flushed through all nozzles in a purging process (also called purges) within a predetermined cycle. This purge cycle may be set corresponding to the print utilization (EP 2 418 087 A1).

The danger that nozzles of the nozzle units dry out additionally increases with decreasing humidity in the environment of the nozzle plate of the print head. This applies in particular to new ink types.

In U.S. Pat. No. 4,228,442 A, a drying of the ink in the nozzles of the print head is prevented in that the nozzle plate with the nozzles is arranged in a nozzle chamber to which a fluid is supplied that may then be evaporated in the nozzle chamber. The moisture in the nozzle chamber is thereby increased, and a drying of the ink in the nozzles is largely prevented.

US 2011/0273 510 A1, U.S. Pat. No. 8,622,538 B2 describe an ink printing apparatus with a print head unit with multiple print heads arranged in series. A recording medium is moved past the print heads with a transport arrangement. The transport arrangement has roller pairs between which the recording medium travels through. The roller pairs are respectively arranged before a print head. The unit made up of print heads and the recording medium are entirely encased in the region of the print head unit in order to avoid ink escaping from the print head unit into the environment. Provided before the print head unit is an arrangement that blows a damp gas into the housing in the direction of the print head unit, in parallel with the recording medium. Due to the roller arranged before the respective print head, this gas is swirled and thereby moves through below the adjacently situated print head. The exit of the print head is thereby dampened and a drying of the ink is prevented.

In JP 2005-271314 A, an ink printing apparatus is described in which ink vapor generated under the print heads during print operation should be removed. For this, a first arrangement is arranged to one side of the print heads as viewed in the transport direction of the recording medium, which first arrangement blows air in the gap between print head and recording medium, across a channel arranged at the one side wall of the print head. Arranged at the other side wall of the print head is an additional channel at which a second arrangement is provided that suctions the air with the ink vapor out of the gap. The air supplied via the first arrangement may be humidified.

SUMMARY

It is an object to specify an ink printing apparatus in which the moisture in the region of the nozzles of a print head or of multiple print heads may be affected so that a drying out of the ink is avoided.

In a printing apparatus a print bar assembly is provided with multiple print bars, a designed space being present between the print bars and a recording medium. A climate control has a feed channel running parallel to a length of the recording medium. Openings lead from the feed channel to the print bars to introduce a conditioned gas flow of predetermined temperature and moisture to the print bars such that a laminar gas flow is generated in the designed space between nozzle plates of the print bars and the recording medium. A barrier is arranged at an intake of the print bar assembly which blocks an air boundary layer entrained with the moving recording medium before the print bar assembly.

DESCRIPTION OF EXEMPLARY EMBODIMENTS

Figure 1:
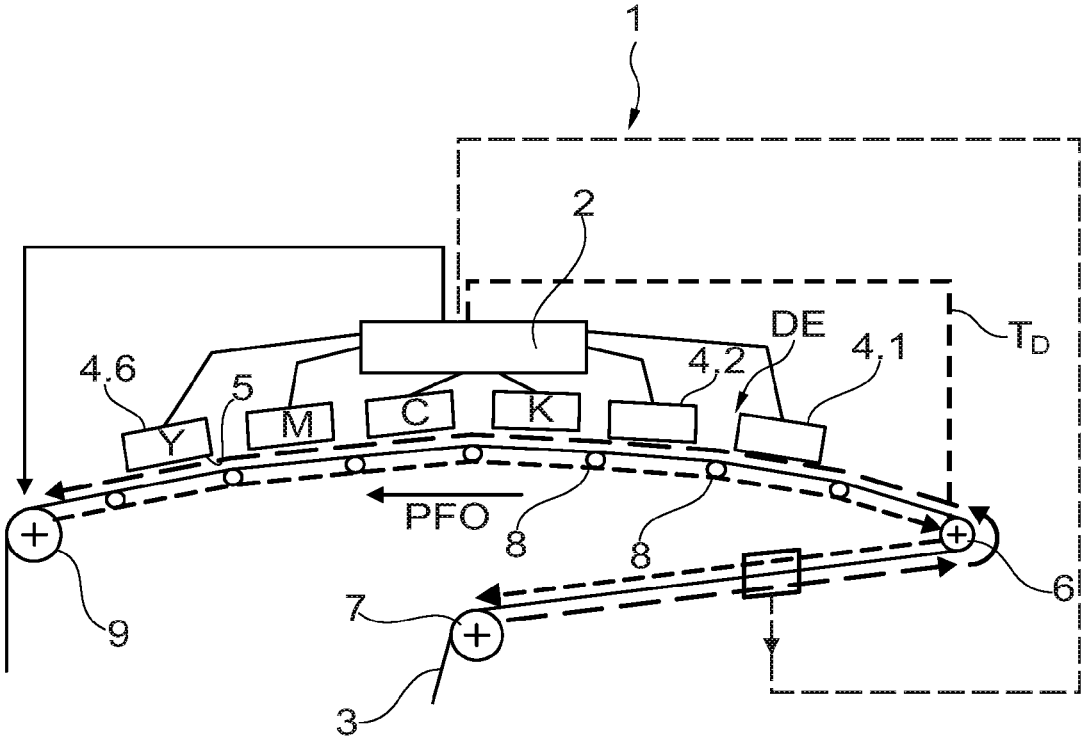
FIG. 1 is a principle presentation of a printer of an ink printing apparatus with a print bar assembly.

For the purposes of promoting an understanding of the principles of the invention, reference will now be made to the preferred exemplary embodiments/best mode illustrated in the drawings and specific language will be used to describe the same. It will nevertheless be understood that no limitation of the scope of the of the invention is thereby intended, and such alterations and further modifications in the illustrated embodiments and such further applications of the principles of the invention as illustrated as would normally occur to one skilled in the art to which the invention relates are included herein.

The ink printing apparatus provides a print bar assembly with multiple print bars arranged over the width of the recording medium, which print bars have at least one print head. A designed space exists between the nozzle plates of the respective print heads of the print bar of the print bar assembly and the recording medium, across which designed space ink droplets are transferred from the print heads to the recording medium upon printing. In order to avoid a drying of the ink in the nozzles of the print heads, a climate control arrangement with an air conditioner may be provided, from which a supply channel traveling parallel to the extent of the recording medium exits, adjacent to the print bar assembly. Openings may lead from the supply channel to the print bars in order to introduce an air conditioning gas flow of predetermined temperature and moisture to the print bars, transverse to the transport direction of the recording medium and parallel to the plane of said recording medium, such that

- a laminar gas flow is generated between the print bars given a moving recording medium,
- a laminar gas flow is generated in the designed space between the nozzle plates and the recording medium given a stationary recording medium in a printing pause.

Additionally, via a barrier—for example an air knife (air blade, air curtain)—arranged across the recording medium, before the print bar assembly (as viewed in the transport direction of the recording medium), the air boundary layer that was previously situated on the recording medium may be stripped away and specifically replaced by a laminar gas flow.

In the following explanation of the exemplary embodiment, air is used as a gas, without the exemplary embodiment being limited to air. The air may be sourced from the environment of the ink printing apparatus.

Advantages of the exemplary embodiment are:

- The evaporation of the water and solvent portions of the ink is reduced via the increase of the relative humidity of the air at the nozzle plate.
- The operating times of the print heads without stripping of the ink from the nozzle plate (wiping) or flushing of the nozzles (purging) may be extended, and the drying out of the nozzles of the print heads may be largely prevented.
- The use of inks of the most recent generation, for example latex inks, is possible.

The exemplary embodiments are further explained based on the schematic drawing Figures.

Of an ink printing apparatus, what is shown according to FIG. 1 is: a printer 1 for printing to a recording medium 3; a transport unit for the recording medium 3; and a printer controller 2. Arranged along the recording medium 3 is a print bar assembly DE which has print bars 4 with print heads 5 in series, as viewed in the transport direction PF0 of the recording medium 3. Given color printing, a respective print bar 4 may be provided per color to be printed, for example. The recording medium 3 is moved by a transport past the print bars 4 comprising drive rollers 7, 9 and a roll saddle 8 with guide rollers. Arranged at the intake of the print bar assembly DE is a sensor 6 that generates print clock pulses $T_D$ depending on the feed movement of the recording medium 3, which print clock pulses $T_D$ are supplied to the printer controller 2 and are used by said printer controller 2 in order to—for example—establish the point in time of the ejection of ink droplets at the nozzles of the individual print heads 5 if print data ready for printing are present in the printer controller 2. For example, the sensor may be executed as a rotary encoder or encoder roller 6 that is driven by the recording medium 3.

In the following, the assembly made up of print bars 4 and print heads 5 is designated as a print bar assembly DE.

Figure 2:
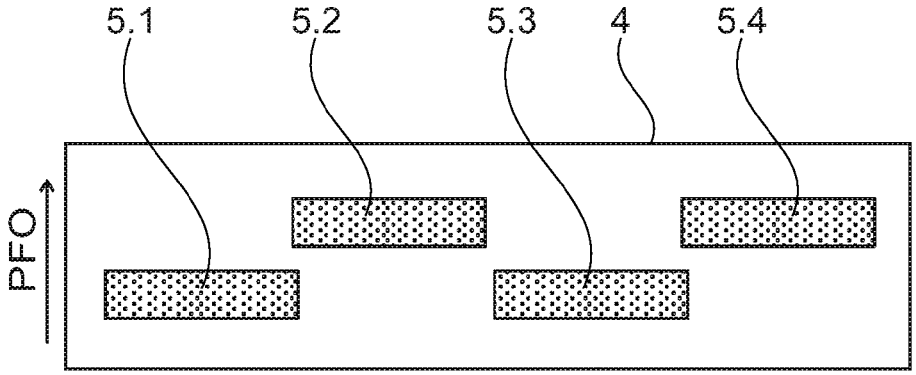
FIG. 2 is a principle presentation of a print bar with multiple print heads.

According to FIG. 2, a print bar 4 has, for example, four print heads 5.1 through 5.4. The print heads 5 within a print bar 4 are, for example, arranged offset from one another in two rows. The travel direction of the recording medium 3 (not shown) is indicated by the arrow PF0.

Figure 3:
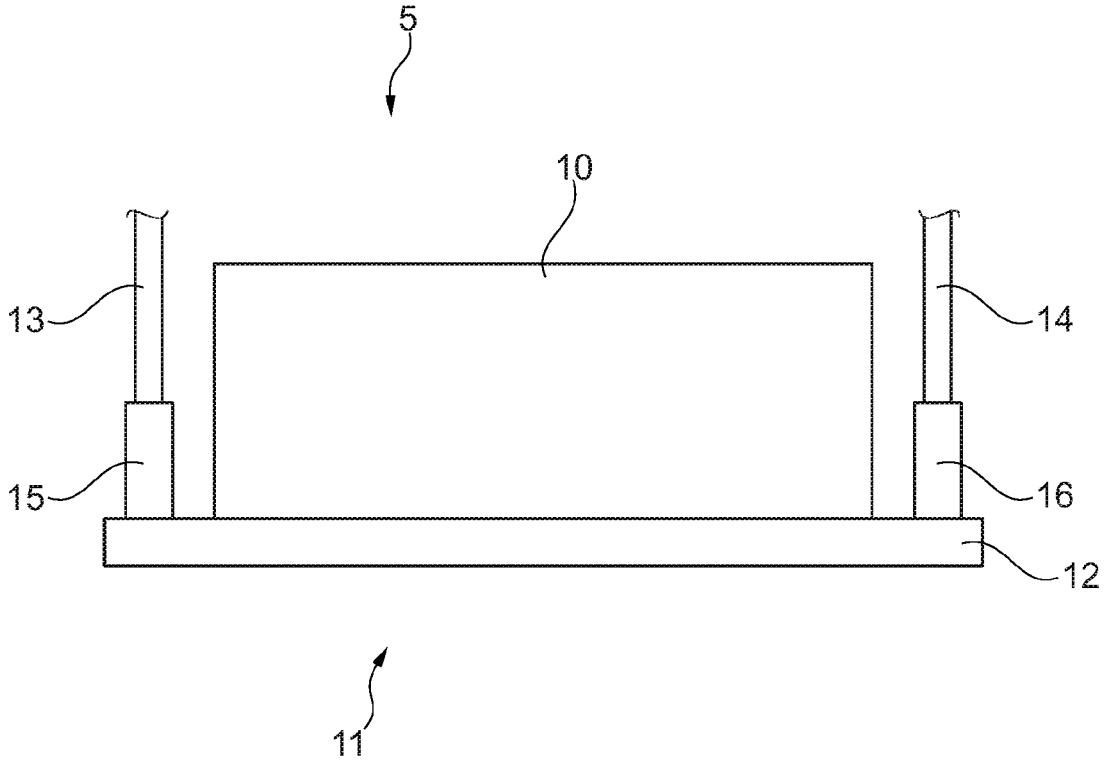
FIG. 3 is a principle presentation of a print head in a front view.

FIG. 3 schematically shows an example of a print head 5 that provides a housing 10 for a control circuit and nozzle assemblies 11. The print head 5 may have a nozzle plate 12 in which are arranged nozzles connected with a respective ink channel. Furthermore, a supply line 13 for the supply of ink to the respective nozzle assembly 11 and a supply line 14 for a discharge of ink from the respective nozzle assembly 11 are provided. The nozzles of the nozzle plate 12 are respectively coupled via ink channels with activators via which the ejection of ink droplets in the direction of the recording medium 3 is induced if a print signal has been fed from the control to the corresponding activator. The supply of ink to the nozzle assembly 11 or the discharge of ink from the nozzle unit 11 respectively takes place with a supply terminal 15 or 16 for the supply line 13 or 14.

In operation, ink is supplied to the nozzles arranged in the nozzle plate 12 via ink channels connected with the supply line 13. If the activator associated with a nozzle is activated via the control circuit, this nozzle ejects an ink droplet. In contrast to this, no ink is ejected at the remaining nozzles that are not activated, the ink channels of which have likewise been supplied with ink, such that the danger exists that the ink in these nozzles dries out. This in particular applies given the use of novel ink types. The drying of the ink in the nozzles is based on the evaporation of water or solvents that are significant components of the ink.

In order to prevent a drying of the ink in the nozzles, the relative moisture (humidity, for example) at the nozzle assembly 11 may be increased, in particular at the nozzle plate 12 (and therefore at the nozzles). One possibility in order to increase the relative humidity at the nozzle plate 12 or to regulate this is to condition the air in the print bar assembly DE.

Figure 4:
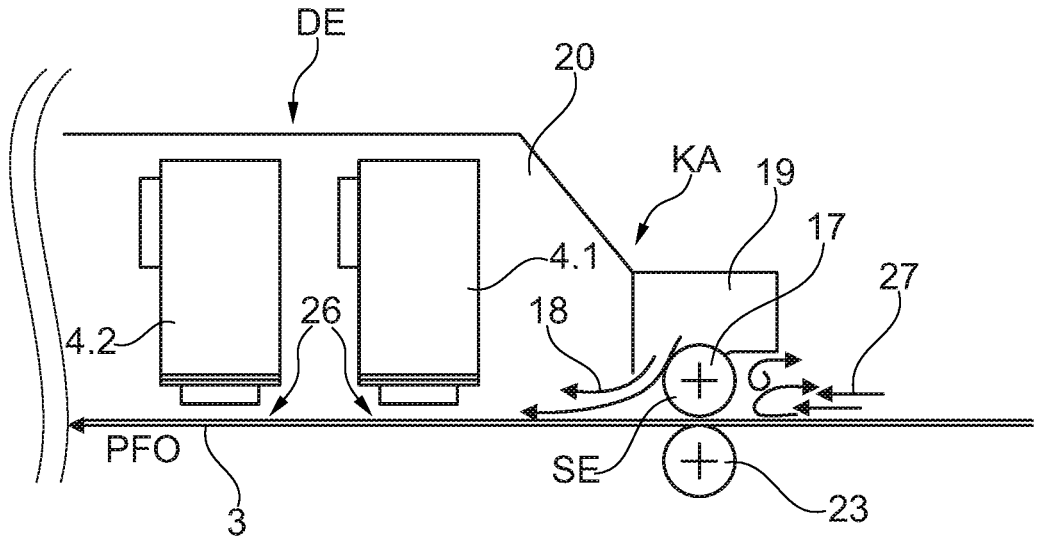
FIG. 4 is a principle presentation of a print bar assembly with a first realization of a barrier to block the air boundary layer on the recording medium before reaching the print bar assembly.
Figure 5:
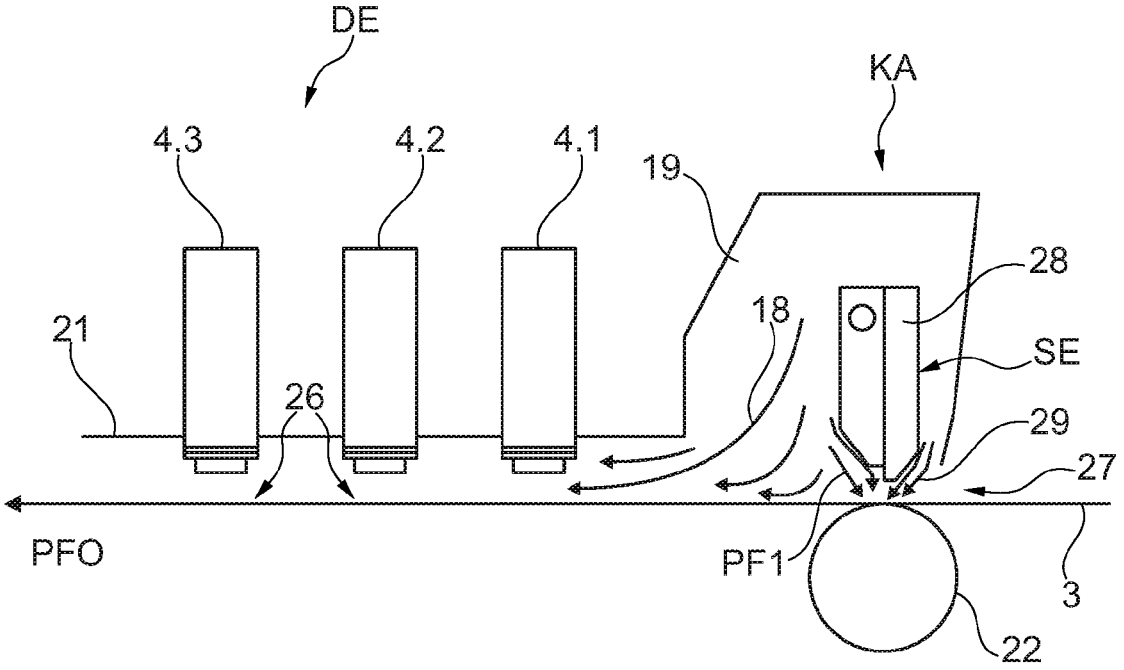
FIG. 5 is a principle presentation of a print bar assembly with a second realization of a barrier to block the air boundary layer on the recording medium before reaching the print bar assembly.

In an embodiment according to FIG. 4 or FIG. 5, a climate control of the print heads 5 of the print bar 4 of a print bar assembly DE according to FIG. 1 may be achieved in that a conditioned air flow of predetermined temperature and moisture is applied at an angle onto the recording medium 3 before the first print bar 4.1, such that a laminar air boundary layer 18 is created on the recording medium 3, which laminar air boundary layer 18 is moved via the recording medium 3 past the print heads 5, through the designed space 26, up to the exit of the print bar assembly DE, beginning before the print heads 5 of the first print bar 4.1 up to the exit of the print heads 5 of the last print bar 4.6 (as viewed in the transport direction PF0 of the recording medium 3). The conditioned air flow 18 may be generated with the aid of a climate control KA having an air conditioner 19, which climate control KA is arranged at the intake of the print bar assembly DE as viewed in the transport direction PF0 of the recording medium 3.

In order to generate a defined air boundary layer 18 via the climate control KA, it is appropriate to remove the air boundary layer 27 that was previously present on the recording medium 3. For this, a barrier SE (for example a slide roller 17 resting on the recording medium 3) may be arranged before the air conditioner 19, as viewed in the transport direction PF0 of the recording medium 3. This slide roller 17 (which may interact with a counter-pressure roller 23) thus has the task of preventing the entrance of the air flow over the recording medium 3 into the designed space 26 of the first print bar 4.1. A new laminar air boundary layer 18 may then be developed on the recording medium 3 in the designed space 26, which new laminar air boundary layer 18 is directed through between the print bars 4 and the recording medium 3 via the movement of said recording medium 3. This air boundary layer 18 may be generated by the air conditioner 19 from the ambient air of the print bar assembly DE and be moistened, and then may be blown onto the recording medium 3 at an angle at the beginning of the print route of the print bar unit DE. The air boundary layer 18 applied onto the recording medium 3 is entrained by the recording medium 3, directed past the print bars 4, and leaves the print bar assembly DE after the last print bar 4.6 (according to FIG. 1). Upon passage of the air boundary layer 18 below the print bar assembly DE, this is additionally dampened by ink vapors exiting from the print heads 5.

The air conditioner 19 in the climate control KA may be of a known design and have a damper (for example an ultrasonic atomizer with atomizer nozzles) and a heater and cooler assembly. With the air conditioner 19, both the relative moisture and the temperature of the air boundary layer 18 may be adjusted. For example, the climate at the nozzle plates 12 (FIG. 3) may then be adjusted to 25° C. and approximately 70% relative moisture.

In order to protect the environment of the ink printing apparatus from contamination by ink, a cover housing 20 may be arranged over the print bar assembly DE (FIG. 4). Of the print bar assembly DE according to FIG. 1, two print bars 4.1 and 4.2 are depicted here. Beginning before the first print bar 4.1, the cover housing 20 extends over the print bars 4, via which the print bars 4 (not the recording medium 3) are closed off from the outside.

A cover housing 21 may also be executed corresponding to FIG. 5. Here the cover housing 21 essentially closes off the region of the nozzle plates 12 of the print heads 5 of the print bar 4. In contrast to FIG. 4, here an air knife 28 of known design is arranged as a barrier SE adjacent to the recording medium 3, before the print bar 4.1, which air knife 28 generates an air curtain 29 on the recording medium 3 and thereby walls off the air boundary layer 27 on the recording medium 3 from the print bar assembly DE. This is represented in FIG. 5 by the arrows PF1, which indicate the course of the air curtain 29. A counter-pressure roller 22 may be arranged opposite the air knife 28. The barrier SE may be supplemented by an adjacently arranged climate control KA with an air conditioner 91 in order to introduce additional conditioned air 18 into the designed space 26 between the print heads 5 of the print bars 4 and the recording medium 3.

Figure 6:
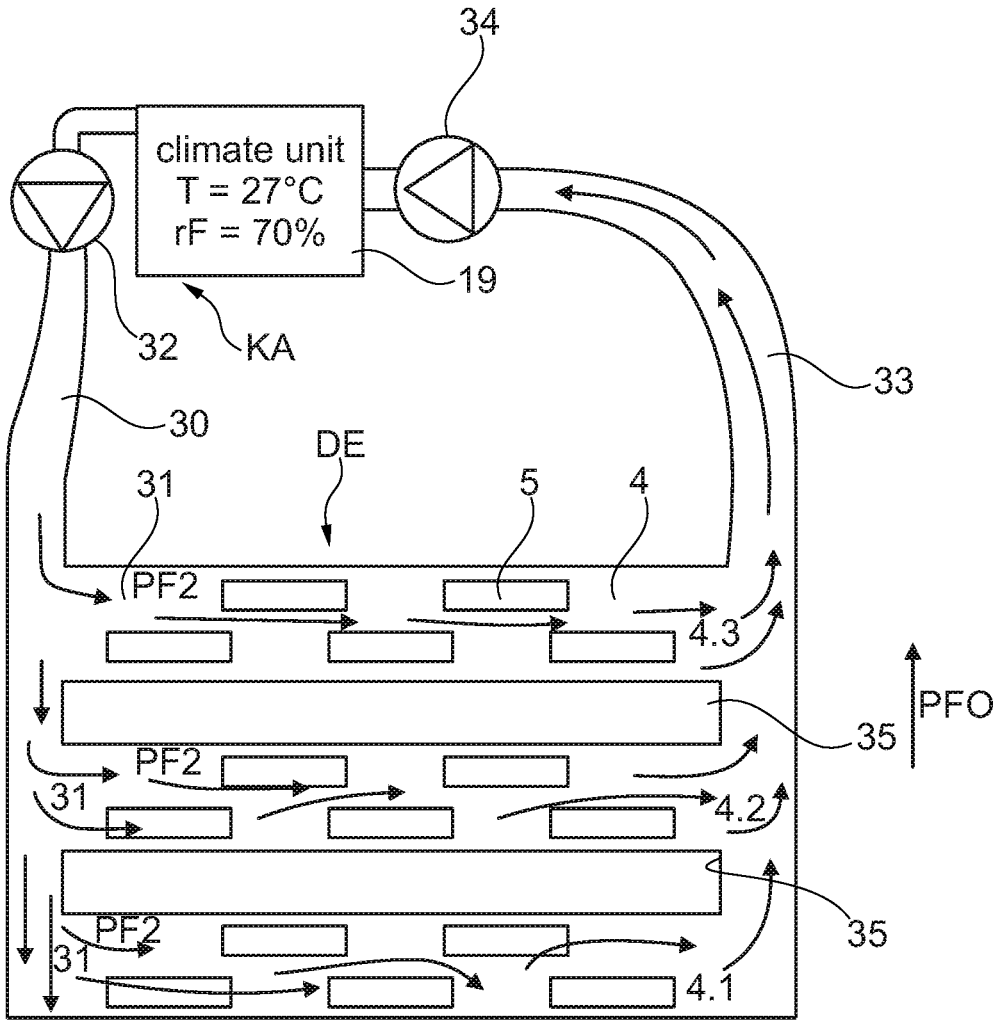
FIG. 6 is a principle presentation of a print bar assembly with an exemplary embodiment of a climate control assembly via which conditioned air is introduced into the print bar assembly along the extent of the print bar.

In contrast to the embodiment of the climate control KA according to FIGS. 4 and 5, according to the exemplary embodiment the climate control of the print heads 5 of the print bars 4 may take place via introduction of conditioned air orthogonal to the transport direction PF0 of the recording medium 3. A schematic example is presented in FIG. 6. The climate control KA here has an air conditioner 19 and at least one feed channel 30 leading to the print bars 4. The feed channel 30 may be arranged lateral to the print bar assembly DE and parallel to the transport direction PF0, which feed channel 30 has openings 31 facing towards the print bars 4, via which the conditioned air may be introduced—transverse to the transport direction PF0—over the length of the print bars 4. The course of the conditioned air in the print bar assembly DE is indicated by the arrows PF2. The print heads 5 of three print bars 4.1 through 4.3 are depicted schematically. The feed channel 30 is connected with the air conditioner 19, which blows the conditioned air into the feed channel 30 with the aid of a ventilator 32. The air conditioner 19 may be arranged outside of the print bar assembly DE. The air escaping from the print bar assembly DE on the opposite side of the print bars 4 may be collected in a discharge channel 33 and be returned to the air conditioner 19 again via a ventilator 43, for example. However, this air may also be released into the environment of the printer 1.

Figure 7:
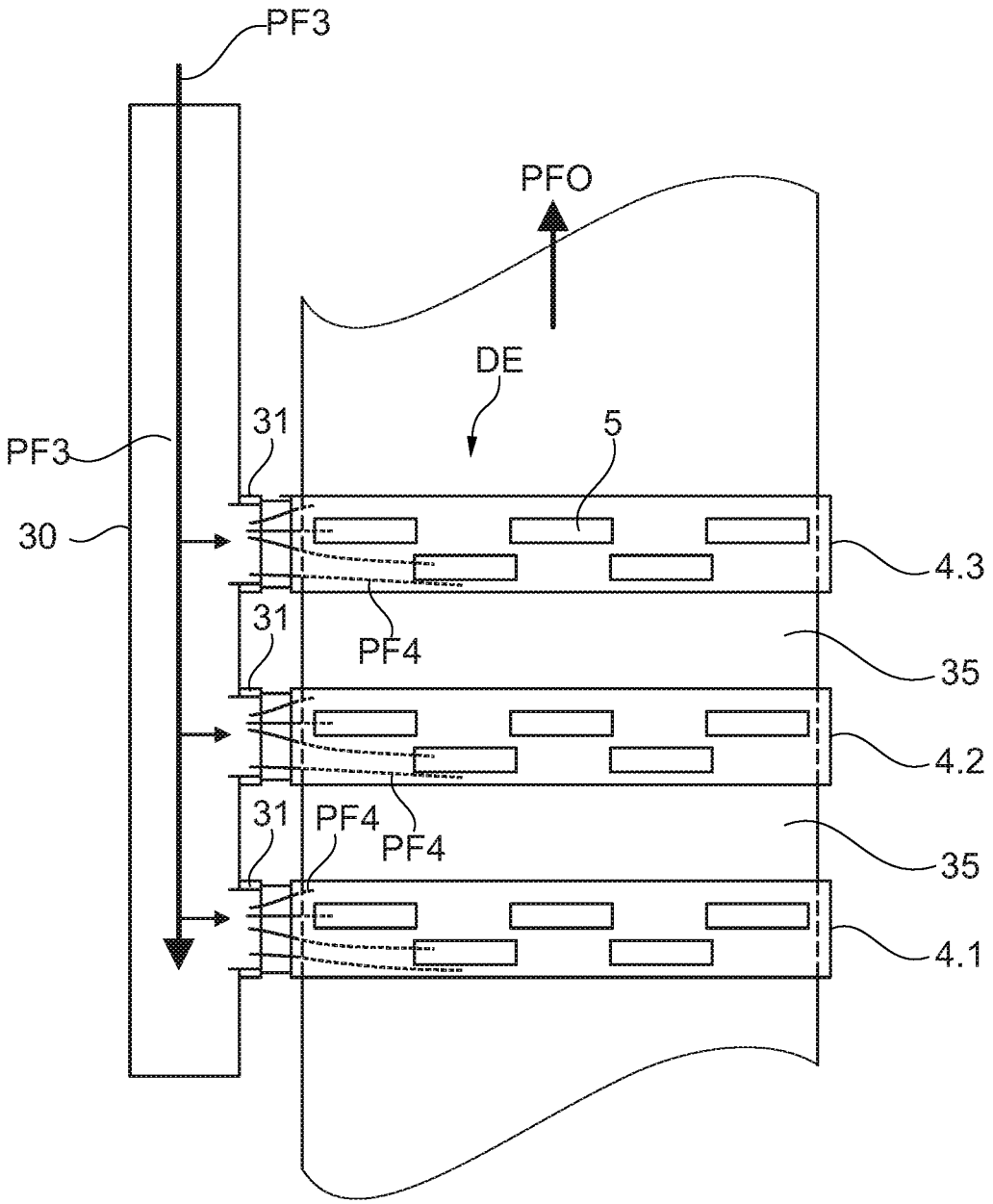
FIG. 7 is a presentation of the flow direction of the conditioned air through the designed spaces of the print bar assembly given the use of the embodiment of the climate control according to the exemplary embodiment.

A schematic depiction from above of the print bar assembly DE of a first example of a flow guidance of the conditioned air through the print bar assembly DE may be learned from FIG. 7; the transport direction of the recording medium 3 is again indicated by the arrow PF0. Here the conditioned air is directed through below the print heads 5, in the designed space 26 between the nozzle plates of the print heads 5 and the recording medium 3. The conditioned air is supplied to the print bar assembly DE via the feed channel 30 arranged lateral and parallel to the recording medium 3, and is directed into the respective designed space 26 via a respective opening 31 per print bar 4. The course of the air flow in the feed channel 30 is indicated by a bold arrow PF3. The course of the conditioned air in the designed space 26 between the print bars 4 and the recording medium 3, which conditioned air has been introduced into the designed spaces 26 under the print bars 4 through the openings 31, is depicted with more narrowly drawn arrows PF4 in order to indicate the respective strength of the air flow. In this embodiment, no conditioned air is guided into the interstices 35 between the print bars 4. This flow guidance of the air is advantageous in particular when the recording medium 3 is not moved and the ink printing apparatus has a printing pause.

Figure 8:
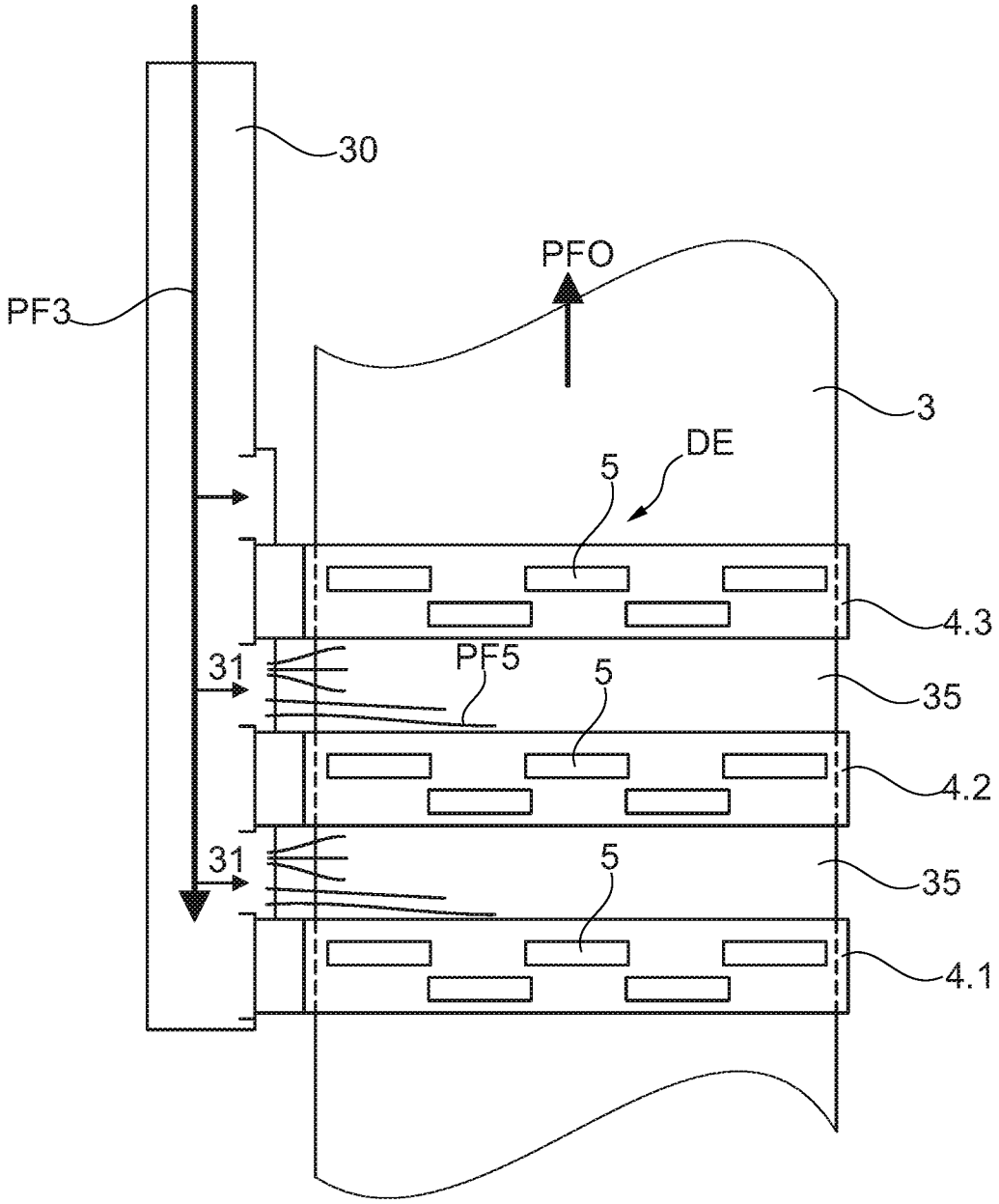
FIG. 8 is a presentation of the flow direction of the conditioned air through the interstices between the print bars of the print bar assembly given the use of the embodiment of the climate control arrangement according to the exemplary embodiment.

An additional example of a flow guidance of the conditioned air in the print bar assembly DE may be learned from FIG. 8. Here the feed channel 30 has openings 31 to the interstices 35 between the print bars 4. The conditioned air escaping from the feed channel 30 therefore sweeps along the side walls of the print bars 4 and cools and dampens the air in the interstices 35 between the print bars 4. The remaining design of the arrangement may be learned from FIG. 7. This flow guidance of the air is advantageous in particular when the recording medium is moving and the ink printing apparatus is in printing operation.

In the exemplary embodiments of FIGS. 7 and 8, a barrier SE is arranged at the intake of the print bar assembly DE (corresponding to FIG. 4 or 5) in order to block the air boundary layer 27 on the recording medium 3 before said recording medium 3 is transported into the print bar assembly DE. The barrier SE may be executed as a slide roller (FIG. 4) or air knife (FIG. 5). Additionally, in both exemplary embodiments of a barrier SE conditioned air may be blown into the designed space 26 of the first print bar 4.1 with the aid of an additional air conditioner 19.

In an advantageous development of the invention, the exemplary embodiments of FIGS. 7 and 8 may be combined. Conditioned air may then be supplied to the designed spaces 26 between the print heads 5 of the print bars 4 and the recording medium 3 (in particular in a printing pause) and to the interstices 35 between the print bars 5 (in particular in printing operation).

For the regulation of the temperature and the relative moisture below the print bar assembly DE, in particular in the designed space 26 between the nozzle plates 12 of the print heads 5 and the recording medium 3, a regulator RE may be used that measures data of the environment of the ink printing apparatus (for example environment temperature, relative humidity) and compares these measurement data with the corresponding measurement data in the print bar assembly DE and—given deviation of these data from predetermined nominal data—adjusts the cooler 19 so that the relative moisture and temperature are set to the nominal value in the designed space 26. For example, the temperature at the print bar assembly DE may be adjusted so that the relative moisture in the designed space 26 is 70% to 90%. The relative moisture in the designed space 26 should be below 100% in order to avoid a condensation of the cooling medium on the surface of the nozzle plates 12.

Figure 9:
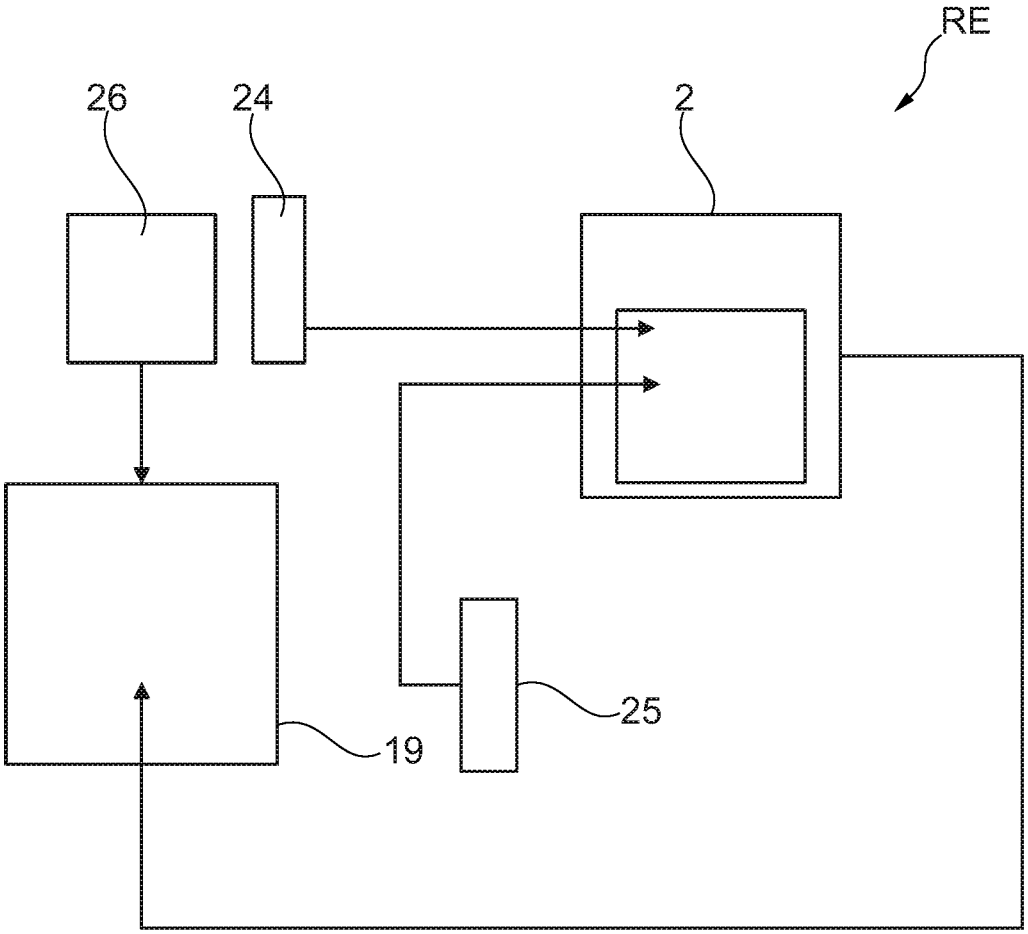
FIG. 9 is a regulator to regulate a climate control to adjust the conditioned air in the print bar assembly.

FIG. 9 shows an example of a regulator RE. In the print bar assembly DE, the relative moisture and the temperature are measured with sensors 24. These measurement values are fed to the printer controller 2. Furthermore, the relative moisture and the temperature of the environment of the print bar assembly DE are measured with sensors 25. The measurement values are in turn supplied to the printer controller 2. Depending on the deviation of the measurement values from one another and from predetermined nominal values, the printer controller 2 generates a control signal that is fed to the air conditioner 19, which adjusts the temperature and the moisture of the air boundary layer 18.

REFERENCE LIST

RE regulator
DE print bar assembly
KA climate control
SE barrier
1 printer
2 printer controller
3 recording medium
4 print bar
5 print head
6 rotary encoder
7 drive roller
8 roll saddle
9 drive roller
10 housing
11 nozzle assembly
12 nozzle plate
13 supply line
14 supply line
15 terminal
16 terminal
17 slide roller
18 air boundary layer
19 air conditioner
20 cover housing
21 cover housing
22 counter-pressure roller
23 counter-pressure roller
24 sensor
25 sensor
26 designed space
27 air boundary layer
28 air knife
29 air curtain
30 feed channel
31 openings
32 ventilator
33 discharge channel
34 ventilator
35 interstice Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim:

1. An ink printing apparatus, comprising:

a print bar assembly with multiple print bars arranged over a width of a recording medium, the print bars respectively having at least one print head, a designed space being present between the print bars and the recording medium, across said designed space ink droplets being transferred to the recording medium upon printing;

a transport for the recording medium, said transport directing the recording medium past the print bar assembly;

a climate control comprising an air conditioner and from which is arranged a feed channel traveling parallel to a length of the recording medium adjacent to the print bar assembly, wherein the feed channel is configured to introduce a conditioned gas flow of predetermined temperature and moisture to the print bars transverse to a transport direction of the recording medium and parallel to a plane of the recording medium such that, given a moving recording medium, a laminar gas flow is generated between two print bars, and such that, given a stationary recording medium, a laminar gas flow is generated in said designed space between nozzle plates of the print bars and the recording medium; and a barrier arranged, as viewed in the transport direction of the recording medium, at an intake of the print bar assembly, the barrier being configured to block an air boundary layer entrained with the moving recording medium before the print bar assembly.

2. The ink printing apparatus according to claim 1, wherein:

the feed channel includes openings adjacent to the respective designed space between the print bars and the recording medium in which the conditioned gas flow is introduced to the respective designed spaces and flows between the print bars and the recording medium; and the feed channel includes openings adjacent to interstices formed between adjacent ones of the print bars in which the conditioned gas flow is introduced to and flows in the interstices formed between adjacent ones of the print bars.

3. The ink printing apparatus according to claim 1, wherein the climate control further comprises a discharge channel configured to discharge the gas flows escaping from the print bar assembly.

4. The ink printing apparatus according to claim 1, wherein the barrier comprises an air knife configured to generate an air curtain, the air knife being arranged such that the air curtain of the air knife strikes the recording medium to block the air boundary layer entrained by the recording medium.

5. The ink printing apparatus according to claim 4, further comprising an additional air conditioner that is arranged at the air knife, the additional air conditioner being configured to generate an additional conditioned gas flow in a direction of the intake of the print bar assembly.

6. The ink printing apparatus according to claim 1, further comprising a cover housing that encases the print bar assembly to protect an environment against contamination with ink.

7. The ink printing apparatus according to claim 1, further comprising a regulator that is configured to regulate temperature and moisture in the designed space of the print bar assembly so that the relative moisture in the designed space is between 70% and 90%.

8. The ink printing apparatus according to claim 1, wherein the laminar gas flow generated between the two print bars and the laminar gas flow generated in the designed space flow across the print medium transverse to the transport direction of the recording medium.

9. The ink printing apparatus according to claim 1, wherein the feed channel extends along a lateral side of the recording medium and parallel to transport direction.

10. The ink printing apparatus according to claim 1, wherein the conditioned gas flow flows across the print medium in a direction transverse to the transport direction.

11. The ink printing apparatus according to claim 9, wherein the conditioned gas flow flows from a first lateral side of the print medium to a second lateral side opposite the first lateral side so as to flow across the print medium in the direction transverse to the transport direction.

12. An ink printing apparatus, comprising:

a print bar assembly with multiple print bars arranged over a width of a recording medium, the print bars respectively having at least one print head, a designed space being present between the print bars and the recording medium, across said designed space ink droplets being transferred to the recording medium upon printing;

a transport for the recording medium;

a climate control comprising an air conditioner and from which is arranged a feed channel to the print bar assembly, wherein the feed channel is configured to introduce a conditioned gas flow of predetermined temperature and moisture to the print bars transverse to a transport direction of the recording medium such that the conditioned gas flow flows across the print medium transverse to the transport direction; and wherein, given a moving recording medium, a laminar gas flow is generated between two print bars, and given a stationary recording medium, a laminar gas flow is generated in said designed space between nozzle plates of the print bars and the recording medium; and a barrier arranged, as viewed in the transport direction of the recording medium, at an intake of the print bar assembly, the barrier being configured to block an air boundary layer entrained with the moving recording medium before the print bar assembly.

13. The ink printing apparatus according to claim 12, wherein the feed channel is further configured to introduce the conditioned gas flow to the print bars parallel to a plane of the recording medium.

14. The ink printing apparatus according to claim 12, wherein, when the recording medium is moving in the transport direction, a portion of the conditioned gas flow that flows across the print medium transverse to the transport direction is drawn into the designed space between nozzle plates of the print bars and the recording medium by the movement of the recording medium.

* * * * *